US009945188B2

(12) United States Patent
Lim et al.

(10) Patent No.: US 9,945,188 B2
(45) Date of Patent: Apr. 17, 2018

(54) ENHANCED INTERCONNECT FOR DOWNHOLE TOOLS

(71) Applicant: Halliburton Energy Services, Inc., Houston, TX (US)

(72) Inventors: Choon Siang Daniel Lim, Singapore (SG); Lay Wei Apple Ang, Singapore (SG); Vinodh Kumar Palani, Singapore (SG); Agustin Gubuan, III, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 567 days.

(21) Appl. No.: 14/404,238

(22) PCT Filed: Sep. 27, 2012

(86) PCT No.: PCT/US2012/057451

§ 371 (c)(1),
(2) Date: Nov. 26, 2014

(87) PCT Pub. No.: WO2014/051580

PCT Pub. Date: Apr. 3, 2014

(65) Prior Publication Data

US 2015/0292273 A1 Oct. 15, 2015

(51) Int. Cl.
*E21B 17/02* (2006.01)
*E21B 17/04* (2006.01)

(52) U.S. Cl.
CPC ..... *E21B 17/028* (2013.01); *E21B 17/04* (2013.01)

(58) Field of Classification Search
CPC ..... E21B 17/028; E21B 17/04; E21B 17/02; E21B 17/042
See application file for complete search history.

(56) References Cited

U.S. PATENT DOCUMENTS 7,084,782 B2 8/2006 Davies et al.
2003/0075319 A1 4/2003 Chau
(Continued)

FOREIGN PATENT DOCUMENTS

EP 2295707 A2 3/2011

OTHER PUBLICATIONS

Office Action issued in related Singapore Application No. 11201502257X, dated May 6, 2016 (7 pages).
(Continued)

*Primary Examiner* — Caroline N Butcher
(74) *Attorney, Agent, or Firm* — Alan Bryson; Baker Botts L.L.P.

(57) ABSTRACT

A system and method for an enhanced interconnect for downhole tools along a drill string used in subterranean operations is described herein. The system (300) may include a first drill string segment (302) comprising a first conductive element (306) and a second drill string segment (304) coupled to the first drill string segment. The system may also include a tool connect assembly (310) disposed within an internal bore of the second drill string segment. The tool connect assembly may comprise a second conductive element (312) electrically connected to the downhole tool, and the second conductive element may be electrically coupled to the first conductive element through at most two electrical interfaces.

18 Claims, 2 Drawing Sheets

(56) References Cited

U.S. PATENT DOCUMENTS

| | | | | |
|---|---|---|---|---|
| 2004/0242044 | A1 | 12/2004 | Head | |
| 2011/0057810 | A1* | 3/2011 | Partouche | E21B 17/028 340/854.4 |

OTHER PUBLICATIONS

International Search Report and Written Opinion issued in related PCT Application No. PCT/US2012/057451 dated Sep. 16, 2013, 10 pages.

* cited by examiner

ENHANCED INTERCONNECT FOR DOWNHOLE TOOLS

CROSS-REFERENCE TO RELATED APPLICATION

This application is a U.S. National Stage Application of International Application No. PCT/US2012/057451 filed Sep. 27, 2012, which is hereby incorporated by reference in its entirety.

BACKGROUND

The present disclosure relates generally to well drilling operations and, more particularly, to an enhanced interconnect for downhole tools.

Existing well drilling operations require information on formation characteristics to aid in drilling decisions. Numerous measurement techniques are used, including logging while drilling (LWD), measuring while drilling (MWD), and wireline tests. MWD and LWD operations, for example, utilize multiple downhole tools with sensors that may be incorporated at various locations along a drill string. Measurements taken by the LWD and MWD tools may be transmitted to the surface as telemetry data. Incorporating the LWD and MWD tools within the telemetry system and drill string can sometimes require complex connectors that have to be specially manufactured and that include sensitive, internal electrical connections. These connectors increase the overall cost and complexity of a drilling operation, and can increase the non-productive time of a drilling rig due to the unreliability of the connectors and the time spent servicing them.

FIGURES

Some specific exemplary embodiments of the disclosure may be understood by referring, in part, to the following description and the accompanying drawings.

Figure 1:
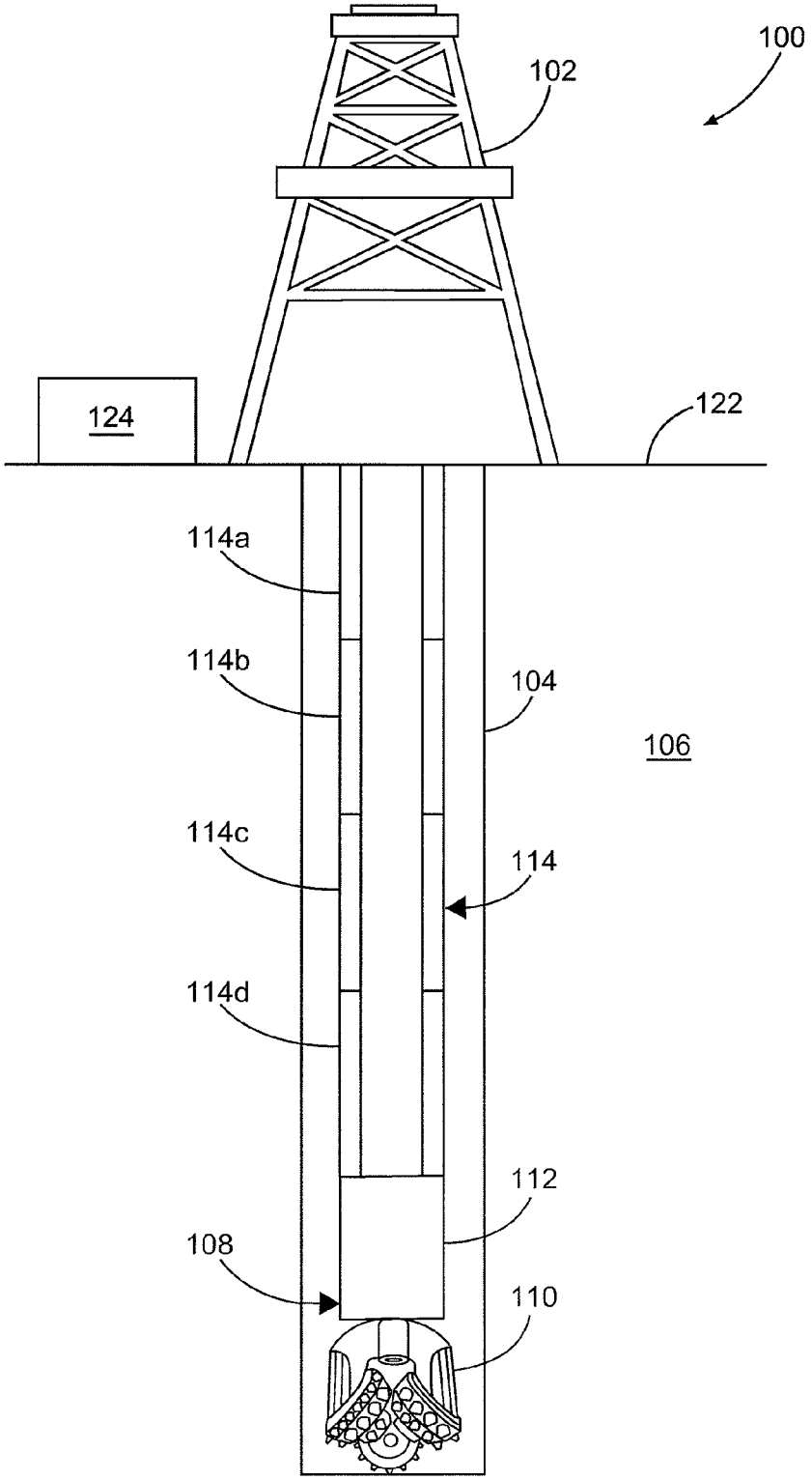
FIG. 1 illustrates an example drilling system, according to aspects the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to an enhanced interconnect for downhole tools.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Devices and methods in accordance with embodiments described herein may be used in one or more of MWD and LWD operations. Embodiments described below with respect to one implementation are not intended to be limiting.

According to aspects of the present disclose, a system and method for an enhanced interconnect for downhole tools along a drill string used in subterranean operations is described herein. The system may include a first drill string segment comprising a first conductive element and a second drill string segment coupled to the first drill string segment. The drill string segments may comprise drill pipe segments, drill collars, downhole tools, or other portions of the drill string that may be appreciated by one of ordinary skill in view of this disclosure. The system may also includes a tool connect assembly disposed within an internal bore of the second drill string segment. The tool connect assembly may comprise a second conductive element electrically connected to the downhole tool, and the second conductive element may be electrically coupled to the first conductive element through at most two electrical interfaces. The electrical interfaces may include, for example, connector pairs. As will be discussed below, reducing the number of electrical interfaces may increase the reliability of the downhole tools by ensuring proper transmission of telemetry signals. Additionally, by reducing the number of electrical interfaces, the complexity and number of components may be decreased.

FIG. 1 shows a drilling system 100. The drilling system 100 includes a rig 102 mounted at the surface 122, positioned above a borehole 104 within a subterranean formation 106. The rig 102 may be connected to a drill string 114, which may include various drilling mechanisms and segments. The drill string 114 may include drill string segments, including drill pipe segments 114*a-d*. Other drill string segments may include, for example, drill collars, downhole tools, and other parts of the bottom-hole assembly (BHA). The drill pipe segments 114*a-d* may comprise machined drill pipe segments, each with a substantially similar configuration. In certain embodiments, the drilling system 100 may include a wired telemetry system that includes conductive elements, and that may transmit telemetry/control/power signals to and from control unit 124, positioned at the surface 122, and downhole tools positioned downhole along the drill string 114. In certain embodiments, as will be discussed below, each of the drill pipe segments 114*a-d* may include a conductive element disposed in a longitudinal channel of the corresponding pipe segment, with the conductive elements coupling electrically to transmit signals.

The drill string 114 may also include a BHA 108 coupled to one of the drill pipe segments. The BHA 108 may include various elements, some of which may be characterized as drill string segments, including drill collars, downhole tools, and subs, such as stabilizers, reamers, shocks, and hole-openers. In FIG. 1, the BHA 108 comprises drill bit 110 and a downhole tool 112. The downhole tool 112 may be, for example, a LWD or MWD sub that measures or logs the formation 106 while the borehole 104 is being drilling. The downhole tool 112 may also comprise other tools useful in drilling operations. The downhole tool 112 may include a variety of sensors and may also include a downhole power source, processor, and memory, such that the measurements may be transmitted to the surface controller 124 over a telemetry system. Although the downhole tool 112 is shown incorporated within the BHA 108, it should be understood that downhole tools can be incorporated at multiple places along the drill string 114, including between drill pipe segments 114*a-d*.

Figure 2:
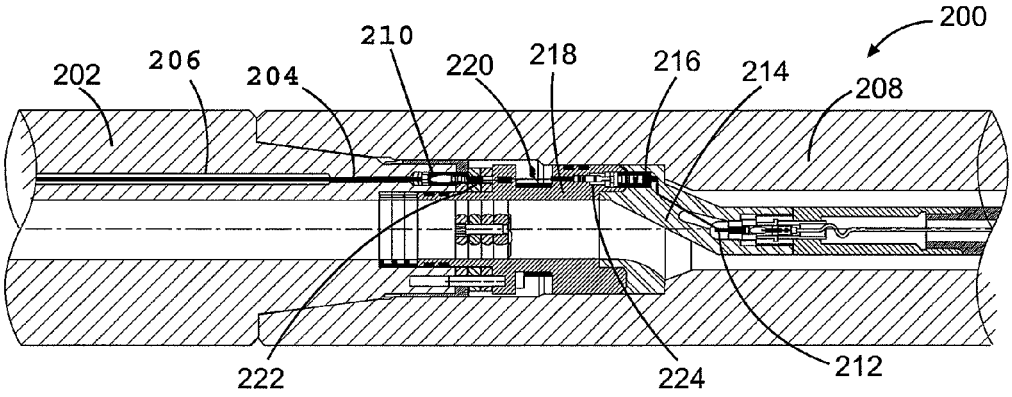
FIG. 2 illustrates an example connection.

Connecting downhole tools to a wired telemetry system may be problematic. FIG. 2 shows an example existing connection to a drill string segment. In FIG. 2 the drill string segment is a wired drill pipe 202 with a conductive element 204 disposed in a longitudinal channel 206 within the wired drill pipe 202. The wired drill pipe 202 may be coupled via threaded engagement with drill string segment 208. The conductive element 204 may terminate at a connector 210 disposed within a pin segment of the wired drill pipe 202. A hanger assembly 214 may be disposed within an internal bore of the drill string segment 208, and may include an internal conductive element 212 that may connect, for example, with a downhole tool positioned below the drill string segment 208. The conductive element 212 may terminate at an upper portion of the hanger assembly 214 at a connector 216.

Positioned between the hanger assembly 214 and the wired drill pipe 202 may be a bulkhead assembly 218. The bulkhead assembly 218 may be specially manufactured to bridge the distance between the hanger assembly 214 and the wired drill pipe 202, and may comprise at least three electrical interfaces, including wire splice 220. Electrical interfaces may be characterized as a joint between two different conductive media, such as two wires, two connectors, etc. In FIG. 2, connector 222, positioned in the bulkhead assembly 218, may be of the same type as and form a connector pair with connector 210. The connector pair comprising the connector 210 and the connector 222 may represent a first electrical interface. Likewise, connector 224, positioned in the bulkhead assembly 218, may be of the same type as and form a connector pair with connector 216. The connector pair comprising the connector 216 and the connector 224 may represent a second electrical interface. Wire splice 220 may electrically couple the connector 222 with connector 224 within the bulkhead assembly, representing the third electrical interface. Similar bulkhead assemblies 218 with three or more electrical interfaces are widely used to connect downhole elements to a power or telemetry system. Unfortunately, the number of electrical interfaces in the bulkhead assembly 218 can reduce the reliability of the tools that communicate over the interfaces. Likewise, the use of the bulkhead assembly generally is not ideal, as it increase the complexity of the connections and that overall cost of the drilling operation.

Figure 3:
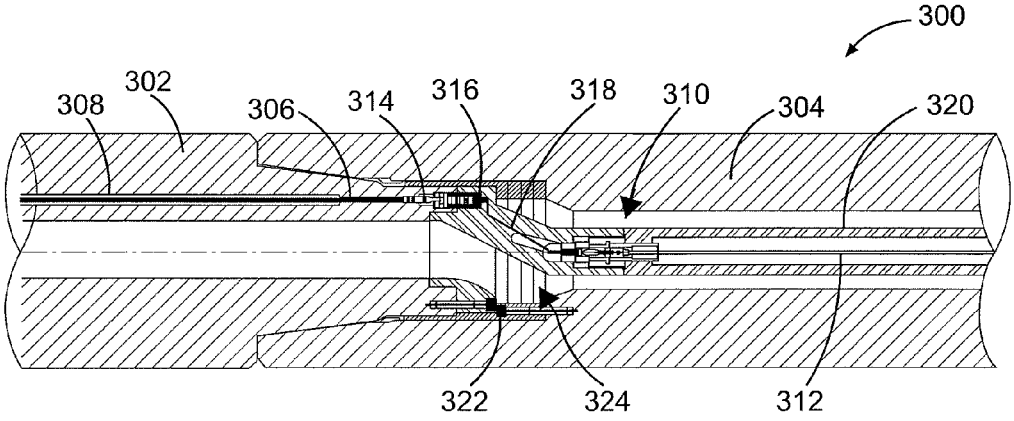
FIG. 3 illustrates an example connection, incorporating aspects of the present disclosure.

According to aspects of the present disclosure, systems and methods for connecting downhole tools described herein may not require the bulkhead assembly shown in FIG. 2, reducing the complexity of the design, and may also operate using at most two electrical interfaces, increasing the reliability of the downhole tools. Moreover, the number of electrical interfaces may be reduced, including eliminating wire splices, which may increase the reliability of the tool. For example, FIG. 3 shows an example connection 300 according to aspects of the present disclosure. As can be seen and will be discussed below, the connection 300 does not include a bulkhead assembly and has a single electrical interface. The connection of FIG. 3 comprises a first drill string segment 302 coupled to a second drill string segment 304. The first drill string segment 302 may comprise a wired drill pipe with a conductive element 306 disposed within a longitudinal chamber 308. A tool connect assembly 310 may be disposed within an internal bore of the second drill string segment 304. The tool connect assembly 310 may comprise a second conductive element 312 electrically connected to a downhole tool (not shown). The telemetry system may be coupled at the connection 300 using at most two electrical interfaces between the tool connect assembly and the first drill string segment.

The embodiment shown in FIG. 3 includes only one electrical interface, the connector pair incorporating first connector 314 and second connector 316. The first connector 314 may be coupled to first conductive element 306, and may be at least partially disposed on an end portion of the first drill string segment 302 proximate the tool connect assembly 310. The second connector 316 may be coupled to second conductive element 312 and may be at least partially disposed in an end portion of the tool connect assembly 310 proximate to the first drill string segment 302. The first connector 314 and second connector 316 may be the same type of connector, and may be coupled directly, such that they form a connector pair. By including only a single electrical interface, and eliminating the wire splice described above with respect to FIG. 2, the connection shown in FIG. 3 may generate a more reliable connection to the downhole tool, leading to less non-productive drilling time. Additionally, as can be seen and will be discussed below, the tool connect assembly 310 is coupled directly to the first drill string segment 302 without a bulkhead assembly, reducing the cost and complexity of the connection.

The tool connect assembly 310 shown in FIG. 3 comprises a hard connect tool interface with a hanger assembly 318 and a hard connect assembly 320. The second connector 316 may be at least partially disposed within the hanger assembly 318. The hanger assembly 318 may be positioned within a chamber 322 of the second drill string segment 304. The chamber 322 may be defined in part by an interior wall of the second drill string segment 304 with a diameter greater than the borehole diameter of the second drill string segment 304. The connection 300 may further include at least one spacer 324 positioned between the hanger assembly 316 and the bottom of the chamber 322. The spacers 324 may be included such that the hanger assembly 318 is positioned within the chamber 322 to contact the bottom of the first drill string segment 302 when the first drill string segment 302 is coupled to the second drill string segment 304. By positioning the hanger assembly 318 relative to the first drill string segment 302, the first conductive element 306 may be electrically coupled to the second conductive element 312 without requiring a bulkhead assembly to bridge the distances between the two.

Figure 4:
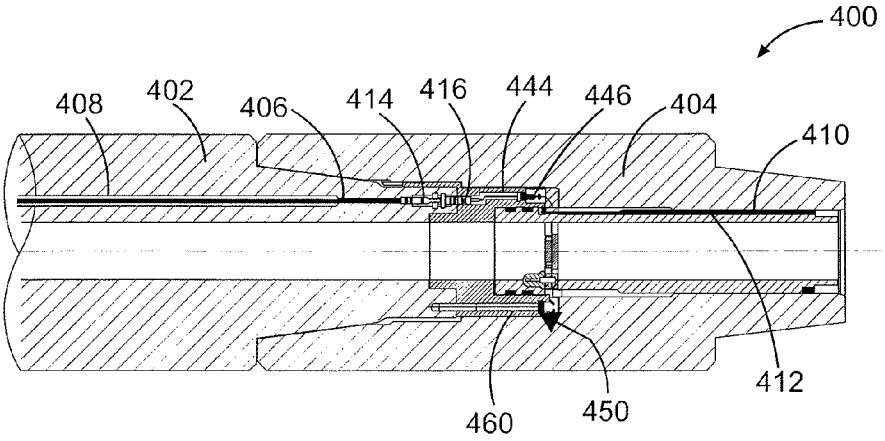
FIG. 4 illustrates an example connection, incorporating aspects of the present disclosure.

FIG. 4 shows another example connection 400 according to aspects of the present disclosure. Notably, the connection 400 does not include a bulkhead assembly and has two electrical interfaces, without a wire splice. The connection 400 comprises a first drill string segment 402 coupled to a second drill string segment 404. The first drill string segment 402 may comprise a wired drill pipe with a conductive element 406 disposed within a longitudinal chamber 408. A tool connect assembly 410 may be disposed within an internal bore of the second drill string segment 404. The tool connect assembly 410 may comprise a second conductive element 412 electrically connected to a downhole tool (not shown). The second conductive element 412 may be electrically coupled to the first conductive element 406 through two electrical interfaces, as will be discussed below.

The embodiment shown in FIG. 4 includes two electrical interfaces: a connector pair incorporating first connector 414 and second connector 416, and a connector pair incorporating third connector 444 and fourth connector 446. The first connector 414 may be coupled to first conductive element 406, and may be at least partially disposed on an end portion of the first drill string segment 402 proximate to an adapter 450. The fourth connector 446 may be coupled to second conductive element 412 and may be at least partially disposed in an end portion of the tool connect assembly 410 proximate to the adapter 450. As can be seen, the connection 400 may include an adapter 450 positioned between the tool connect assembly 410 and the first drill string segment 402, which may electrically couple the first conductive element 406 to the second conductive element 412 using first connector 414, second connector 416, third connector 444, and fourth connector 446.

The second connector 416 and the third connector 444 may be disposed in the adapter 450. The second connector 416 may correspond to the first connector 414 and may form a first connector pair or electrical interface. The third connector 444 may correspond to the fourth connector 446, and may form a second connector pair or electrical interface. The second connector 416 and third connector 444 may be coupled together within the adapter 450, without the use of a wire splice. As will be appreciated by one of ordinary skill in the art, by including at most two electrical interfaces, and eliminating the wire splice described above with respect to FIG. 2, the connection shown in FIG. 4 may generate a more reliable connection to the downhole tool, leading to less non-productive drilling time.

The tool connect assembly 410 further comprises an annular connect assembly. In particular, the annular connect assembly may comprise a tubular body that is disposed within the bore of the second drill string segment 404. The tubular portion may include, for example, a shoulder that rests on a end portion of a chamber 460 within the second drill string segment 404. Second conductive element 412 may be positioned, for example, in an annular chamber between the tubular portion of the tool connect assembly 410 and the second drill string segment 404. By positioning the adapter 450 between the first connector 414 and the fourth connector 446, a standard tool connect assembly 410 may be used within the connection 400. In particular, existing shoulder configurations of the tool connect assembly 410 can be used, and the gap between the tool connect assembly 410 and the first drill string segment may be bridged by the adapter 450, which does not include a wire splice and creates at most two electrical interfaces. Additionally, the use of the adapter allows for the first connector 414 and the fourth connector 226 to be of different types, and yet still able to electrically coupled the first conductive element 406 to the second conductive element 412.

In addition to the system described above, a method for an enhanced interconnect for downhole tools along a drill string used in subterranean operations is also described herein. In certain embodiments, the method includes introducing a first drill string segment into a borehole. The first drill string segment may comprise a first conductive element, and may be a wired drill pipe segment, as described above. The method may also include positioning a tool connect assembly within an internal bore of a second drill string segment. The tool connect assembly may include a second conductive element, and may be, for example, a hard connect tool interface or an annular connect tool interface, as also described above, or may be another tool connect interface well known in the art. The drill string segments may be drill pipe segments, drill collars, downhole tools, subs, such as stabilizers, reamers, shocks, and hole-openers, or other portions of the drill string that may be appreciated by one of ordinary skill in view of this disclosure.

The method may also include threadedly engaging the second drill string segment to the first drill string segment, and electrically coupling the second conductive element to a downhole tool. In certain embodiment, the second drill string segment may be a part of a downhole tool, and electrically coupling the second conductive element to the downhole tool may include connecting the second conductive element directly to a control unit within the second drill string segment. In other embodiments, the downhole tool may be positioned below the second drill string segment, in a different drill string segment, and electrically coupling the second conductive element to the downhole tool may mean connecting the second conductive element to the downhole tool through an intermediate conductor.

The method may further comprise electrically coupling the second conductive element to the first conductive element through at most two electrical interfaces. As described above, electrical interfaces may be characterized as a joint between two different conductive media, such as two wires, two connectors, etc. The electrical interfaces may include, for example, a connector pair, with one half of the connector pair being disposed in the first drill string segment and the second half being disposed in the tool connect assembly. The electrical interfaces may also include at most two electrical interfaces, with the electrical interfaces comprising two connector pairs across an adapter, as described above. In certain embodiments, the at most two electrical interfaces may not include a wire splice, which can decrease the reliability of the tool.

In certain embodiments, the first drill string segment may comprise a first connector coupled to the first conductive element, and the tool connect assembly may comprise a second connector coupled to the second conductive element. Electrically coupling the second conductive element to the first conductive element through at most two electrical interfaces may comprise forming a connector pair using the first connector and the second connector. Certain embodiments may comprise positioning an adapter between the tool connect assembly and the first drill string segment. The first connector and the second connector may be electrically coupled through the adapter. For example, the adapter may comprise a third connector corresponding to the first connector, and a fourth connector corresponding to the second connector. The third connector and the first connector form a first connector pair or electrical interface, and the wherein the fourth connector and the second connector may form a second connector pair or electrical interface.

In certain embodiments, the tool connect assembly may comprise a hanger assembly positioned within a chamber of the second drill string segment, and the second connector may be at least partially disposed within the hanger assembly. The method may further include positioning at least one spacer between the hanger assembly and a bottom of a chamber in the second drill string segment to ensure the tool connect assembly and the first drill string segment contact to electrically couple the conductive element. In certain other embodiments, the tool connect assembly may comprises an annular connect assembly and may use an adapter to couple to the first conductive element.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A system for an interconnect for downhole tools along a drill string used in subterranean operations, comprising:

a first drill string segment comprising a first conductive element;

a second drill string segment coupled to the first drill string segment;

a chamber of the second drill string segment, the chamber being defined in part by an interior wall of the second drill string segment with a diameter greater than a diameter of a borehole of the second drill string segment;

a tool connect assembly disposed within an internal bore of the second drill string segment, wherein:

the tool connect assembly comprises a second conductive element electrically connected to the downhole tool and a hanger assembly positioned within the chamber, and the second conductive element is electrically coupled to the first conductive element through at most two electrical interfaces; and at least one spacer positioned between the hanger assembly and a bottom of the chamber such that the hanger assembly is positioned within the chamber to contact a bottom of the first drill string segment to electrically couple the first conductive element to the second conductive element.

2. The system of claim 1, further comprising a first connector coupled to the first conductive element and a second connector coupled to the second conductive element.

3. The system of claim 2, wherein the first connector and the second connector form a connector pair.

4. The system of claim 3, wherein the second connector is at least partially disposed within the hanger assembly.

5. The system of claim 2, further comprising an adapter positioned between the tool connect assembly and the first drill string segment, wherein the first connector and the second connector are electrically coupled through the adapter.

6. The system of claim 5, wherein the adapter comprises:

a third connector corresponding to the first connector, wherein the third connector and the first connector form a first connector pair;

a fourth connector corresponding to the second connector, wherein the fourth connector and the second connector form a second connector pair.

7. The system of claim 6, wherein the at most two electrical interfaces comprise the first connector pair and the second connector pair.

8. The system of claim 7, wherein the tool connect assembly comprises an annular connect assembly.

9. A method for an interconnect for downhole tools along a drill string used in subterranean operations, comprising:

introducing a first drill string segment into a borehole, wherein the first drill string segment comprises a first conductive element;

positioning a tool connect assembly within an internal bore of a second drill string segment, wherein the tool connect assembly comprises a second conductive element and a hanger assembly, wherein the second drill string segment comprises a chamber, and wherein the chamber is defined in part by an interior wall of the second drill string segment with a diameter greater than a diameter of a borehole of the second drill string segment;

threadedly engaging the second drill string segment to the first drill string segment;

electrically coupling the second conductive element to a downhole tool;

electrically coupling the second conductive element to the first conductive element through at most two electrical interfaces;

positioning at least one spacer between the hanger assembly and a bottom of the chamber such that the hanger assembly is positioned within the chamber to contact a bottom of the first drill string segment to electrically couple the first conductive element to the second conductive element.

10. The method claim 9, wherein the first drill string segment comprises a first connector coupled to the first conductive element, and wherein the tool connect assembly comprises a second connector coupled to the second conductive element.

11. The method of claim 10, wherein electrically coupling the second conductive element to the first conductive element through at most two electrical interfaces comprises forming a connector pair using the first connector and the second connector.

12. The method of claim 11, wherein the second connector is at least partially disposed within the hanger assembly.

13. The method of claim 10, further comprising positioning an adapter between the tool connect assembly and the first drill string segment, wherein the first connector and the second connector are electrically coupled through the adapter.

14. The method of claim 13, wherein the adapter comprises:

a third connector corresponding to the first connector, wherein the third connector and the first connector form a first connector pair;

a fourth connector corresponding to the second connector, wherein the fourth connector and the second connector form a second connector pair.

15. The method of claim 14, wherein the at most two electrical interfaces comprise the first connector pair and the second connector pair.

16. The method of claim 15, wherein the tool connect assembly comprises an annular connect assembly.

17. A system for an interconnect for downhole tools along a drill string used in subterranean operations, comprising:

a first drill string segment comprising a first conductive element and a first connector coupled to the first conductive element;

a second drill string segment coupled to the first drill string segment and a second connector;

a chamber of the second drill string segment, the chamber being defined in part by an interior wall of the second drill string segment with a diameter greater than a diameter of a borehole of the second drill string segment;

a tool connect assembly disposed within an internal bore of the second drill string segment, wherein:

the tool connect assembly comprises a second conductive element electrically connected to the downhole tool and a hanger assembly positioned within the chamber, the second conductive element is electrically coupled to the first conductive element through the first connector and the second connector; and the second conductive element are not electrically coupled through a wire splice; and at least one spacer positioned between the hanger assembly and a bottom of the chamber such that the hanger assembly is positioned within the chamber to contact a bottom of the first drill string segment to electrically couple the first conductive element to the second conductive element.

18. The system of claim 17, wherein the second conductive element is electrically coupled to the first conductive element through at most two electrical interfaces.

* * * * *